United States Patent [19]

Yanker

[11] Patent Number: 4,585,212

[45] Date of Patent: Apr. 29, 1986

[54] LIFT DEVICE OF THE SCISSOR-JACK TYPE

[75] Inventor: George M. Yanker, Austin, Tex.

[73] Assignee: International Business Machines Corporation, Armonk, N.Y.

[21] Appl. No.: 679,502

[22] Filed: Dec. 7, 1984

[51] Int. Cl.[4] ..... B66F 3/22

[52] U.S. Cl. ..... 254/122

[58] Field of Search ..... 254/122, 9 C, 124, 127; 187/18, 8.71, 8.72; 182/63, 141, 148, 69, 157

[56] References Cited

U.S. PATENT DOCUMENTS

| | | | |
|---|---|---|---|
| 2,862,689 | 12/1958 | Dalrymple et al. | 187/18 |
| 3,222,032 | 12/1965 | Schneider . | |
| 3,472,183 | 10/1969 | Goodman . | |
| 3,785,462 | 1/1974 | Coad et al. | 187/18 |

FOREIGN PATENT DOCUMENTS

| | | | |
|---|---|---|---|
| 2253765 | 8/1973 | Fed. Rep. of Germany | 254/122 |

*Primary Examiner*—Robert C. Watson

*Attorney, Agent, or Firm*—J. F. Villella, Jr.

[57] ABSTRACT

A lifting device of the scissor-jack type comprises two arms that are midway connected by a pivot and carry a platform. One arm carries a pulley between the pivot and one end. On the other side of the pivot is a slideable cam follower. This cam follower rides on a cam surface provided on the other arm. A cable is attached to the cam follower, guided around a pulley and back to the lower end of the cam surface carrying arm. The contour of the cam surface, and the position and diameter of the pulley are chosen such that a predetermined, preferably constant, ratio between input and output is obtained.

10 Claims, 2 Drawing Figures

LIFT DEVICE OF THE SCISSOR-JACK TYPE

TECHNICAL FIELD

The present invention relates to a lift device of the scissor-jack type comprising a base, a platform, scissor-like pivotally connected arms which are pivotally and slideably attached relative to the base as well as to the platform for lifting same with cable means arranged to pull one set of ends of the arms together to perform the lifting action.

Lifting devices of this general type have a wide variety of applications for lifting loads of different kinds and shapes. Lifting devices for units, especially display units, in the data and word processing environment for height adjustment in compliance with the needs of different individual operators, are of increasing importance.

BACKGROUND ART

In U.S. Pat. No. 3,785,462 a lift mechanism of the scissor-jack type is described. This mechanism has a base platform and an elevatable platform interconnected by sets of spaced pairs of scissor arms pivoted intermediately the ends and pivotally connected to each platform such that relative movement between the respective platforms is accomplished by rotation of the scissor arms about their pivot. One side of the ends of the scissor arms is connected for a sliding motion along each of the platforms to accommodate the opening of the scissors while maintaining the platforms in spaced parallel positions. A combination of a cable and roller cam drive is employed for raising and lowering the platform with respect to the base. The cable is driven by a winch roller mounted on one side of the platform and reeved to pass over roller pulleys connected to each of the ends of scissors at one platform. The roller cam is positioned to drive the closed side of the scissor arms apart by working toward the pivot interconnecting each of the scissor arms with decreasing mechanical advantage during the first portion of the lifting cycle while the roller pulleys are pulled together with increasing mechanical advantage during the last portion of the lifting cycle.

A drawback in this design is that the contribution of the cable means guided over the roller while being pulled toward the pivot of the scissor arms varies with respect to the lifting distance. This means that no constant force over the whole lift distance is attainable. Furthermore, there is no provision for providing a determined, especially a constant and distinct, ratio between input and output forces as well as cable and platform displacement.

In U.S. Pat. No. 2,862,689 another scissor-jack type lifting device is disclosed. This device has a hydraulic pressure device with a cam roller as pushing means which rolls up a ramp, is lifted by that and rolls along a cam surface provided on one arm of the scissor arms. The cam roller is moved away from the scissor arm connection pivot in the lifting movement. This is a rather complicated design of a scissor-like lifting device and needs high power as the force for lifting. The platform is only attacking on one position and no constant ratio between input and output displacement, or between input and output force is disclosed.

Neither of the above-cited U.S. patents singularly nor in combination shows a possibility of designing a distinct, and over the whole lifting range, predetermined and constant input to output ratio of cable displacement and application forces. Furthermore, neither of them shows a cam follower riding on a cam surface toward a pivot connection of the arms when lifting is performed.

DISCLOSURE OF INVENTION

A main object of the present invention is to provide a generally applicable scissor-jack lifting device, actuated by cable means, that has a determined ratio, especially a constant ratio between input and output displacement.

This and other objects are accomplished in accordance with the invention in an advantageous manner by providing a pulley on one of the arms between the pivot connection and one fixing point; providing cam means which act between the two ends of these arms which are on the other side of the pivot connection; guiding the cable which is fixed with its one end to a cam follower, around said pulley and to a reference point underneath the cam means; and, choosing the profile of the cam means, the position and diameter of the pulley such that a predetermined, preferably constant ratio is maintained between the displacement length of that cable and the lift distance of the platform.

The lift device in accordance with the invention has the advantages of a relatively simple design which allows maintaining a predetermined or even constant ratio between the displacement of the cable on the input side and the lift distance on the output side. If this ratio is constant and there is no change in friction forces in the system, there will be no change in the force needed to lift a given load over the entire lift distance. The lift device in accordance with the invention is designed as an independent device which forms an external attachment to any unit being lifted by it. Those units being lifted may well be display units in a data and word processing environment to adjust them in their height in accommodating different individual needs of operators.

BRIEF DESCRIPTION OF DRAWING

In the following, the invention will be described in detail in connection with the accompanying drawing showing an embodiment of the invention, in which.

BEST MODE FOR CARRYING OUT THE INVENTION

Figure 1:
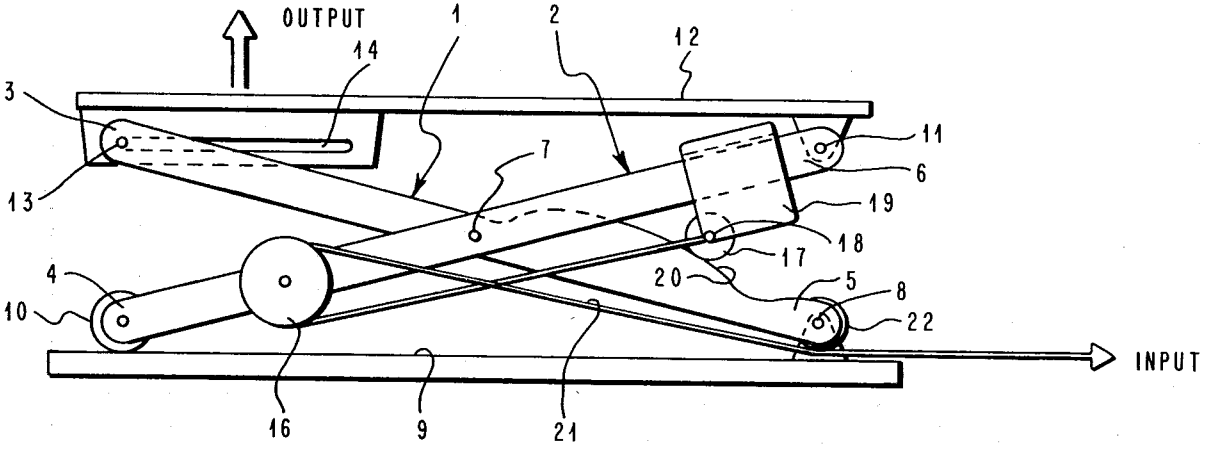
FIG. 1 is a side view showing schematically a lift device in accordance with the present invention.

As shown in the figures, two arms 1 and 2 of a scissor-like jack are pivotally connected, midway their ends 3, 5 and 4, 6, respectively, by a pivot connection 7. Lower end 5 of arm 1 is stationary and pivotally connected by a fixture 8 to base 9. Lower end 4 of the other arm 2 is slideably linked or glidingly attached to base 9 by means of a roller 10. Upper end 6 of arm 2 is pivotally linked to a stationary fixture 11 that is attached to platform 12. Upper end 3 of the other arm 1 is slideably attached to platform 12. As shown in FIG. 1, this could be realized by a pin 13 and slot 14 connection, whereby slot 14 is attached to platform 12, or by a roller 15 which slides underneath platform 12, as shown in FIG. 2.

In accordance with the invention, a pulley 16 is provided on arm 2 between the lower end 4 and the pivot connection 7. Between this pivot connection 7 and the upper end 6 of arm 2, a cam follower realized by a roller 17 is provided. This roller 17 is attached with its axis 18 to a slideable carriage 19. This slideable carriage 19 together with cam follower 17 slides along arm 2 between its upper end 6 and the pivot connection 7. Cam follower 17 rides on a cam surface 20 that is provided on the other arm 1 between its lower end 5 and pivot connection 7. A cable 21 is attached with one end to the axle 18 of cam follower 17, wrapped around pulley 16 and guided back toward a reference point realized by a roller 22 attached to end 5 of arm 1 underneath these cam means. Cable 21 might also be attached to carriage 19, and roller 22 might be provided in proximity to end 5 of arm 1. The other end of cable 21 is then guided to a power source (not shown) which provides the input for the lifting device. When cable 21 is pulled in the input direction indicated by the arrow, the output to lift platform 12 as indicated by the respective arrow is provided.

Figure 2:
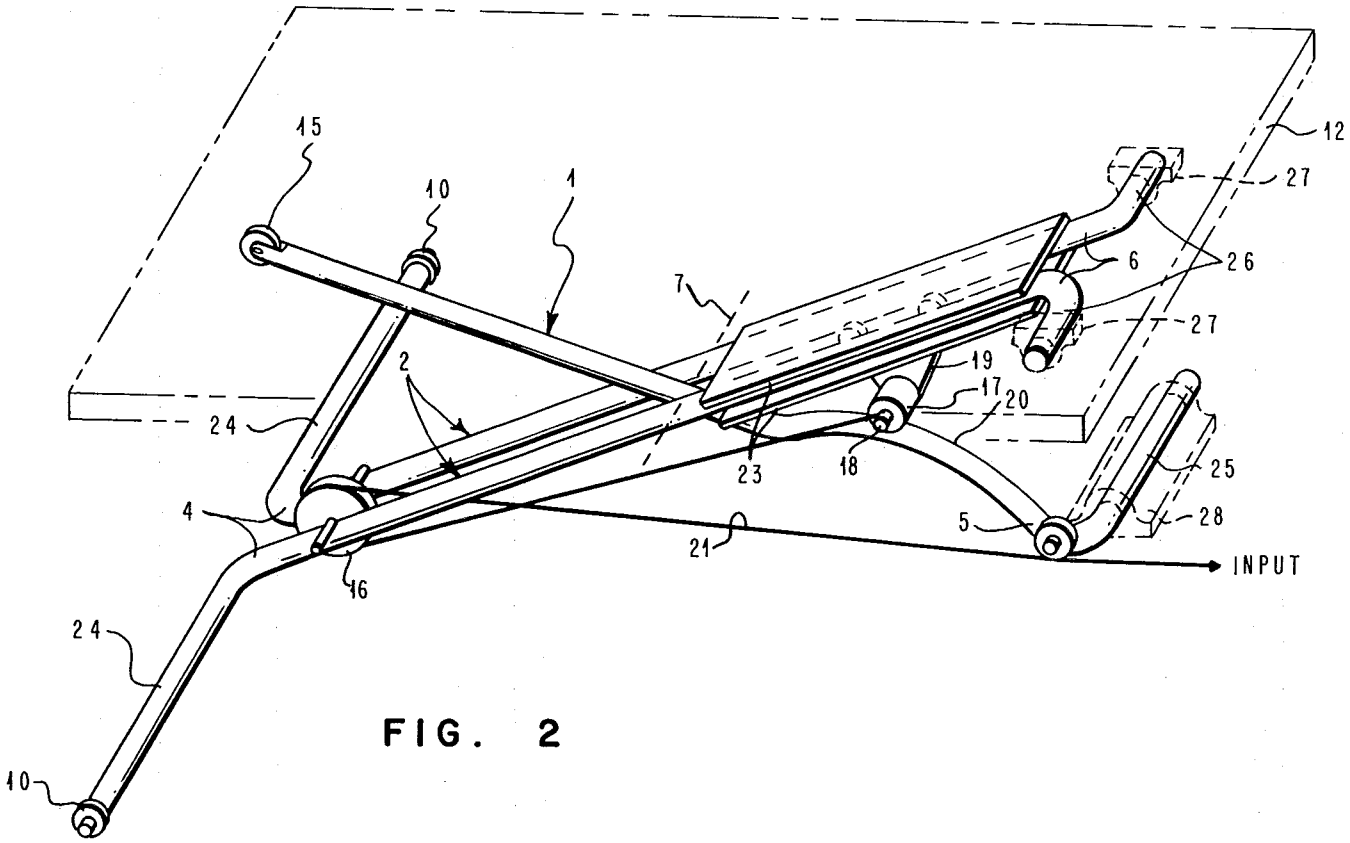
FIG. 2 is a perspective view of a lifting device in accordance with an alternative embodiment of the invention.

The embodiment shown schematically in FIG. 2 in a perspective view includes two members that form arm 2. Between the upper end 6 of this arm 2 and pivot connection 7, two plates 23 are attached on the upper and lower side of the members forming arm 2. These plates 23 define a space in which carriage 19 may be glided on rollers up and down along arm 2. In the lower part of arm 2, pulley 16 is attached between the two members forming this arm. As can be seen further from FIG. 2, no actual base is provided. The base in this embodiment will be realized by a side arm 25 extending from lower end 5 of arm 1 and by two side arms 24 extending sideways from the lower end 4 of arm 2. In operation, arm 25 is held stationary, yet pivotally, on a support (not shown) on which the lift device rests within this arm 25 and rollers 10. Platform 12 rests slideably on roller 15 on its one end and on the other end is attached to side arms 26 of upper ends 6 of arm 2 by means of two attachment collars 27. Cam surface 20 is formed by bending arm 1 in the desired shape or profile which is needed for cam surface 20. No extra attachment formed in accordance with the profile of cam surface 20 is needed.

In operation, cable 21 is displaced in the direction of the arrow on cable 21 to provide the needed input for obtaining a lift action in the direction of the output for lifting platform 12. In the beginning, when platform 12 and the whole scissor-jack lifting device is near its collapsed configuration, the cam follower 17 starts to ride up on the right hand side of cam surface 20 toward pivot connection 7. In this area, as the cam surface is steeper there, the contribution of a small increment of input displacement contributes a large lifting output by cam follower 17. At the same time, the lifting contribution of pulley 16 toward reference roller 22 is essentially smaller. With increasing lifting of platform 12 the lifting contribution of cam follower 17 riding toward pivot connection 7 is decreasing and the lifting contribution due to the displacement of pulley 16 toward input reference roller 22 and therewith toward pivot connection 7 is increasing.

In accordance with the invention, by choosing the correct position of pulley 16 between end 4 and pivot connection 7 on arm 2; by choosing the correct diameter of pulley 16; and, by choosing a specific profile or contour for cam surface 20, a predetermined ratio between input and output displacement of cable 21 and lifting distance of platform 12 is obtainable. With the present invention, a constant ratio between input and output is realized.

Constant input to output ratios between 1:1 and 1:1.5 are readably achievable with the design in accordance with the invention. Ratios outside this range are possible but they are more limited by practical considerations such as: transmission angle between the cam surface 20 and the cam follower 17; the available length of cam surface 17; the height of the cam surface which affects the lowest collapsed height; and, the necessary compromise if it is intended that the ratio be exactly constant.

Input to output ratios on the order of 1:1 are achieved when pulley 16 is positioned farther away from pivot connection 7 and when the contour or profile of cam surface 20 is relatively long and low.

Input to output ratios on the order 1:1.5 are achieved when pulley 16 is positioned closer to pivot connection 7 on arm 2 and when the profile or contour respectively of cam surface 20 is short and high, that is, especially steep at the beginning near the lower end 5 of arm 1.

The manner in which cable 21 is guided by pulley 16 or wrapped around pulley 16 also influences the input to output ratio and the displacement contribution of the different participating members. As shown in both figures, cable 21 is wrapped around pulley 16 in a crossed manner. That means that cable 21 is kept as parallel as possible to the length axis of both arms 1 and 2. In this crossed manner, a slightly increasing amount of cable is wrapped around pulley 16 and stored there as the device lifts. This has the effect of creating an extra output beyond that contributed by the cam surface 20. Thus, the useful ratio is increased at the 1:1.5 end of the range. If cable 21 is wrapped around pulley 16 in the other manner in which no crossing occurs, the effect is that the output is reduced below that contributed by the cam arrangement. Thus the useful design ratio is decreased at the 1:1 end of the ratio range. This effect is influenced by a pulley 16 of larger or smaller diameter.

As shown in FIGS. 1 and 2, the carriage 19 carrying cam follower 17 rides on a straight path relative to arm 2. It is conceivable to provide a curved path so that carriage 19 together with cam follower 17 follows a curved path relative to arm 2. This would have the desirable effect of increasing or decreasing the motion which is otherwise obtained only from the contour of cam surface 20.

In the following, a generation technique for the profile of cam surface 20 is described for a constant input to output displacement ratio.

The dimensions and positions of members 1 through 19 and 21 through 27 are assumed, that is, with the exception of cam surface 20, a desired input to output ratio between 1:1 to 1:1.5 is chosen. A scaled layout, hardware model, or a mathematical model of the lifting device is then constructed for use.

Then the following steps are carried out:

(1) The model of the assembled lifting device is positioned in its lowest position;
(2) Cam follower 17 is positioned at an assumed location for the outer end of the profile of cam surface 20 which is to be generated;
(3) All slack from cable 21 is removed;
(4) The cam cutter position of cam follower 17 is recorded onto arm 1. If a cutter is used, the cutter diameter should be identical to the diameter of the cam follower roller 17;
(5) Cable 21 is pulled out and thereby displaced, and also the output platform 12 is displaced or raised respectively in the exact respective ratio amount which is desired. These displacements must each be the same small fractions, e.g., 1/100, of their respective total displacement ranges;

(6) Steps 3–5 are repeated until the cam cutter positions have been recorded for each fractional displacement of the members;

(7) The resulting cam profile is transferred to arm 1 or to an attachment thereof and incorporated as cam surface 20.

The lifting device constructed in accordance with the invention provides an easy construction with a variety of possibilities to choose the desired ratio between input and output. This might be a determined ratio or a constant ratio especially between 1:1 and 1:1.5 of the displacement of cable 21 and of load carrying platform 12. Furthermore, this device provides a self-contained external unit which easily can be used to carry different loads, especially display units, which might be height adjustable by this lifting device.

While the invention has been particularly shown and described with reference to a preferred embodiment thereof, it will be understood by those skilled in the art that the foregoing and other changes in form and details may be made therein without departing from the spirit and scope of the invention.

I claim:

1. A lift device including a base, a platform, first and second scissor-like arms, connected at a pivot, stationary and slideably attached relative to that base as well as to said platform, said lift device comprising:

a pulley connected to a first arm between said pivot and the end of said first arm adjacent to said base;

cam means including a cam follower on said first arm and a cam surface on said second arm; and, cable means fixed at one end to said cam follower and wrapped around said pulley for displacing said cable means a variable length, thereby moving said cam follower over said cam surface and lifting said platform a distance proportional to said length, the contour of said cam means, the position and diameter of said pulley chosen such that a predetermined ratio is maintained between displacement length of said cable means and lift distance of said platform.

2. A lift device as in claim 1, wherein said predetermined ratio has a constant value.

3. A lift device as in claim 1, wherein:

said cam follower is slideably attached to said first arm; and, said cam surface is provided on the end of said second arm which is adjacent to said platform.

4. A lift device as in claim 1, wherein said cam follower comprises a roller.

5. A lift device as in claim 4, wherein said cam follower is mounted onto a carriage which is slideable on said first arm.

6. A lift device as in claim 5, wherein said carriage moves along a straight path on said first arm.

7. A lift device as in claim 4, wherein said one end of said cable means is fixed to the axis of said cam roller.

8. A lift device as in claim 1, wherein said cable means is wrapped around said pulley and guided toward a point adjacent to where said first arm attaches to said base, in a crossed manner, such that said cable means is guided substantially parallel to the length axis of said first and second arms, and is thereby gradually wound up on said pulley during lifting action of said platform.

9. A lift device as in claim 1, wherein the position of said pulley on said first arm is chosen nearer to said pivot of said first and second arms thereby obtaining a ratio of displacement length to lift distance substantially equal to 1:1.5.

10. A lift device as in claim 1, wherein the position of said pulley on said first arm is chosen farther away from said pivot, thereby obtaining a ratio of displacement length to lift distance substantially equal to 1:1.

* * * * *